US012637858B2

(12) United States Patent
Karlsson et al.

(10) Patent No.: US 12,637,858 B2
(45) Date of Patent: May 26, 2026

(54) FLOOR SYSTEM

(71) Applicant: MITEK HOLDINGS, INC., Wilmington, DE (US)

(72) Inventors: Per Ove Karlsson, Eksjö (SE); Stefan Åsberg, Boxholm (SE); Bo Starby, Eksjö (SE); Peter Koski, Huskvarna (SE)

(73) Assignee: MiTek Holdings, Inc., Wilmington, DE (US)

( * ) Notice: Subject to any disclaimer, the term of this patent is extended or adjusted under 35 U.S.C. 154(b) by 305 days.

(21) Appl. No.: 18/247,657

(22) PCT Filed: Oct. 26, 2021

(86) PCT No.: PCT/US2021/056668
§ 371 (c)(1),
(2) Date: Sep. 14, 2023

(87) PCT Pub. No.: WO2022/093834
PCT Pub. Date: May 5, 2022

(65) Prior Publication Data

US 2024/0102283 A1 Mar. 28, 2024

(30) Foreign Application Priority Data

Oct. 27, 2020 (SE) ..... 2051250-5

(51) Int. Cl.
*E04B 9/18* (2006.01)
*E04B 9/04* (2006.01)
*E04B 9/24* (2006.01)

(52) U.S. Cl.
CPC ..... *E04B 9/18* (2013.01); *E04B 9/04* (2013.01); *E04B 9/245* (2013.01)

(58) Field of Classification Search
CPC ... E04B 9/245; E04B 9/24; E04B 9/18; E04C 3/291; E04C 3/292
See application file for complete search history.

(56) References Cited

U.S. PATENT DOCUMENTS 1,415,273 A * 5/1922 Stevens ..... E04B 9/18 52/39
1,578,964 A * 3/1926 Duphiney ..... E04B 9/18 52/506.08

(Continued)

FOREIGN PATENT DOCUMENTS

CN 209227877 U * 8/2019
CZ 19304 U1 * 2/2009

(Continued)

OTHER PUBLICATIONS

Extended European Search Report, European Application No. 21870208, Oct. 17, 2024, 10 pages.

(Continued)

*Primary Examiner* — Adriana Figueroa
(74) *Attorney, Agent, or Firm* — Stinson LLP

(57) ABSTRACT

A floor joist system (9) comprises a flat sheet metal structural web member (10) for interconnecting a pair of parallel spaced apart wood chord members (11), said web member (10) being V-shaped, comprising first and second legs (12, 13) integrally joined at one of their respective ends, a plurality of teeth struck from said one end of each leg (12, 13) and extending from one face, constituting the inside face, of the web member (10), said teeth being adapted to be driven into one of the chord members (11), and a plurality of teeth struck from the other end of each leg and extending from the inside face of the web member (10), said teeth being adapted to be driven into the other of said chord (Continued)

members (11). The system further comprises a bracket (1) for holding a suspended ceiling.

21 Claims, 2 Drawing Sheets

(56) References Cited

U.S. PATENT DOCUMENTS

| | | | | |
|---|---|---|---|---|
| 3,828,508 | A | 8/1974 | Moeller | |
| 3,998,020 | A | 12/1976 | Kuhr et al. | |
| 3,998,419 | A | 12/1976 | Semmerling | |
| 4,275,541 | A * | 6/1981 | Orals | E04B 5/10 52/745.15 |
| 4,475,328 | A * | 10/1984 | Reeder | E04B 1/49 52/693 |
| 5,024,034 | A | 6/1991 | Gailey | |
| 5,119,612 | A * | 6/1992 | Taylor | E04D 13/1637 52/410 |
| 5,397,090 | A | 3/1995 | Carson et al. | |
| 6,202,969 | B1 | 3/2001 | Orr | |
| 7,735,285 | B2 | 6/2010 | Payne, Jr. | |
| 10,718,113 | B2 | 7/2020 | Baxter et al. | |
| 11,821,203 | B2 | 11/2023 | Pollenus | |
| 2006/0005495 | A1 | 1/2006 | Stessel et al. | |
| 2006/0016138 | A1 | 1/2006 | Blount | |
| 2008/0148667 | A1 | 6/2008 | Payne | |
| 2019/0257083 | A1 | 8/2019 | Baxter et al. | |
| 2022/0213685 | A1 | 7/2022 | Pollenus | |
| 2024/0102283 | A1 | 3/2024 | Karlsson et al. | |

FOREIGN PATENT DOCUMENTS

| | | | | |
|---|---|---|---|---|
| DE | 2608598 | A1 | 9/1977 | |
| DE | 19843839 | A1 * | 3/2000 | E04F 21/185 |
| DE | 202021104162 | U1 * | 9/2021 | E04B 9/24 |
| EP | 2112294 | A1 * | 10/2009 | E04F 13/0826 |
| EP | 2743423 | A1 | 6/2014 | |
| FR | 1402519 | A * | 6/1965 | |
| GB | 2460627 | A * | 12/2009 | E04B 9/245 |
| JP | 05122431 | A | 6/2010 | |
| KR | 20070016916 | A | 2/2007 | |
| WO | 8100425 | A1 | 2/1981 | |

OTHER PUBLICATIONS

International Searching Authority, International Search Report and Written Opinion, International Application No. PCT/US2021/056668, Oct. 26, 2021, 28 pages.

Patent Examination Report #1, New Zealand Application No. 798221, Nov. 18, 2024, 3 pages.

Patent Examination Report #2, New Zealand Application No. 798221, Feb. 4, 2025, 5 pages.

Patent Examination Report #2, New Zealand Application No. 798222, May 20, 2025, 5 pages.

Extended European Search Report from EP Application No. 21887349.5, dated Aug. 9, 2024, 9 pages.

* cited by examiner

FLOOR SYSTEM

CROSS-REFERNCE TO RELATED APPLICATIONS

The present application claims priority to PCT Application No. PCT/US2021/056668, filed Oct. 26, 2021, which claims priority to Sweden Application No. 2051250-5, filed Oct. 27, 2020, the entireties of which are hereby incorporated by reference. CL TECHNICAL FIELD The present invention relates to a floor joist system comprising a flat sheet metal structural web member for interconnecting a pair of parallel spaced apart wood chord members. Saki web member is V-shaped comprising first and second legs integrally joined at one of their respective ends, a plurality of teeth struck from said one end of each leg and extending from one face, constituting the inside face, of the web member, said teeth being adapted to be driven into one of the chord members, and a plurality of teeth struck from the other end of each leg and extending from the inside face of the web member, said teeth being adapted to be driven into the other of said chord members.

The system further comprises a bracket for holding a suspended ceiling, wherein said bracket has a first end for anchoring the bracket to one of said wood chord members, and a second end to which a mounting profile is attachable on which a building panel is mountable. The bracket has a rectangular and flat part that in use is horizontally arranged between the first and second ends of the flat part.

BACKGROUND

There are various suspension solutions for ceilings available. A suspended ceiling is a secondary ceiling, hung below the main (structural) ceiling or the floor system. It may also be referred to as a drop ceiling, T-bar ceiling, false ceiling, dropped ceiling, grid ceiling, drop in ceiling, drop out ceiling, or ceiling tiles and is a staple of modern construction and architecture in both residential and commercial applications. For the sake of facilitating understanding, this type of ceiling will be referred to as "suspended ceiling" throughout the disclosure.

Suspended ceilings and ceiling tiles were being used in Japan for aesthetic reasons as early as the fourteenth century. These could be made with simple planks or coffered. Blackfriars Theater in London, England, built in 1596, had suspended ceilings to aid acoustics.

Many systems for suspended ceilings are directed to be used for ceilings with sound absorbing boards. The suspension assemblies vary from bolts to brackets. More advanced types are available, for instance, comprising springs etc. to achieve acoustic benefits.

SUMMARY

It is an object of the present invention to provide a floor joist system with improved sound insulation. This object is achieved with a floor joist system as defined in the appended claims.

According to a first aspect of the present disclosure a floor joist system comprises a flat sheet metal structural web member for interconnecting a pair of parallel spaced apart wood chord members, said web member being V-shaped, comprising first and second legs integrally joined at one of their respective ends, a plurality of teeth struck from said one end of each leg and extending from one face, constituting the inside face, of the web member, said teeth being adapted to be driven into one of the chord members, and a plurality of teeth struck from the other end of each leg and extending from the inside face of the web member, said teeth being adapted to be driven into the other of said chord members.

The system further comprises a bracket for holding a suspended ceding, wherein said bracket has a first end for anchoring the bracket to one of said wood chord members, and a second end to which a mounting profile is attachable on which a building panel is mountable, the bracket having a rectangular and flat part that in use is horizontally arranged between the first and second ends of the flat part. The length of the flat part between the first and second ends is at least 1.5 times as long as the width of the flat part.

Surprisingly, the dimensions described above as relates to the bracket for a suspended ceiling have shown to improve the noise reduction.

According to a preferred aspect of the present disclosure, the length of the flat part is between 30 and 70 times the thickness of the flat part. Even more preferred is when the length of the flat part is between 40 and 50 times the thickness of the flat part.

According to another aspect of the present disclosure the second end of the bracket has the same width as the flat part and perpendicular to the plane of the flat part pointing downwards in use.

According to a further aspect of the present disclosure the first end of the bracket has a connector part arranged between the first end and an anchor part. The connector part has the same width as the flat part and perpendicular to the plane of the flat part pointing upwards in use.

According to yet another aspect of the present disclosure the anchor part is a flat rectangular part, the length of the anchor part being greater than the width of the connector part, wherein the plane of the anchor part is parallel with the plane of the flat part. The connector part is arranged centrally on one of the long sides of the anchor part, wherein the anchor part further comprising attachment means.

According to yet a further aspect of the present disclosure the attachment means are holes for screws arranged at each end of the anchor part. Thus, the bracket is easily fastened to the building structure and a beam or similar elongate carrier could be attached to the bracket without the need of switching positions upon installation.

The floor joist system according to claim 1, wherein the building panel is a gypsum board.

The building panel comprises a gypsum board and a gypsum fireboard according to an aspect of the present disclosure.

According to a further aspect of the present disclosure the floor joist system further comprises floor chipboard arranged on top of an upper layer of wood chord members.

According to yet a further aspect of the present disclosure the floor joist system further comprises sound insulating mat arranged above the floor chipboard.

According to yet another aspect of the present disclosure the floor joist system further comprises gypsum board arranged above the floor chipboard or above the sound insulating mat if such a mat is present.

According to a preferred aspect of the present disclosure the length of the flat part between the first and second ends is shorter than 2.5 times the width of the flat part. Even more preferred is when the length of the flat part between the first and second ends is longer than 1.6 times the width of the flat part and shorter than 1.8 times the width of the flat part.

For facilitating production, the bracket is made of a single piece of bent metal sheet.

Further features of, and advantages with, the present invention will become apparent when studying the appended claims and the following description. The skilled person realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
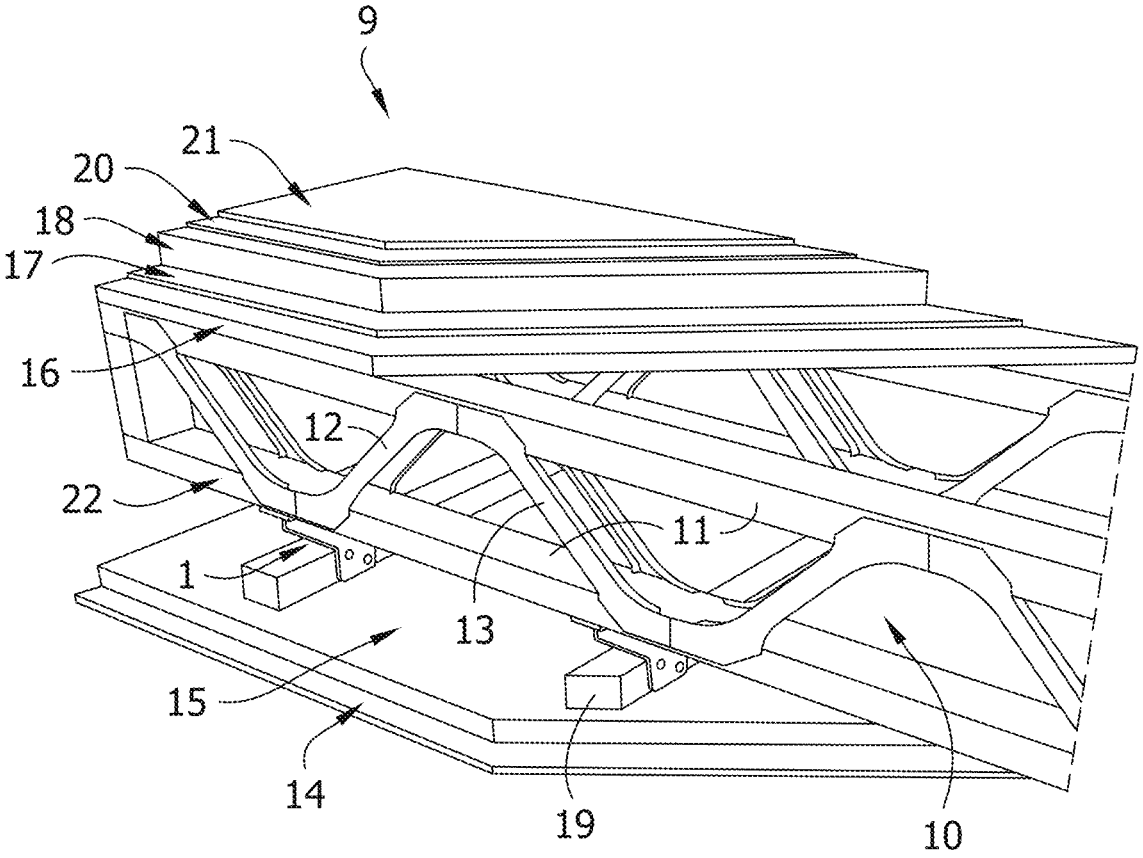
FIG. 1 is a perspective exploded view of a floor joist system according to the present disclosure and FIG. 2 is a perspective view of a bracket according to the present disclosure.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With reference to FIG. 1, a floor joist system 9 is shown comprising a flat sheet metal structural web member 10 for interconnecting a pair of parallel spaced apart wood chord members 11. The web member 10 is V-shaped, comprising first and second legs 12, 13 integrally joined at one of their respective ends.

The system further comprises a bracket 1 for holding the suspended ceiling, wherein said bracket 1 has a first end 2 for anchoring the bracket 1 to one of said wood chord members 11, and a second end 3 to which a mounting profile 19 is attached on which a building panel is mounted. The building panel in the shown embodiment comprises a gypsum board 14 and a gypsum fireboard 15.

Further, the floor joist system 9 comprises a floor chipboard 16 arranged on top of the upper layer of wood chord members 11. A sound insulating mat 17 is arranged above the floor chipboard 16. On top of the sound insulating mat 17 is a gypsum board 18.

The next layer is a parquet underlay 20 and finally the parquet 21 on top.

For further sound insulation, loose mineral wool could be arranged in the cassette 22 created between the floor and the suspended ceiling. In another embodiment, wood fiber insulation can be used in place of the mineral wool. It has been found that it is possible to substitute wood fiber insulation for mineral wool in the floor joist system 9 of the present invention and maintain the acoustic levels of a Class B System. Wood fiber insulation is more environmentally friendly, but would not be capable of the same soundproofing qualities in floor structures of other kinds. Typically, a Class B System would have an airborne sound insulation rating of 56 dB or greater, where the rating is the difference in sound pressure in the room where sound is emitted and the room where sound is received.

Figure 2:
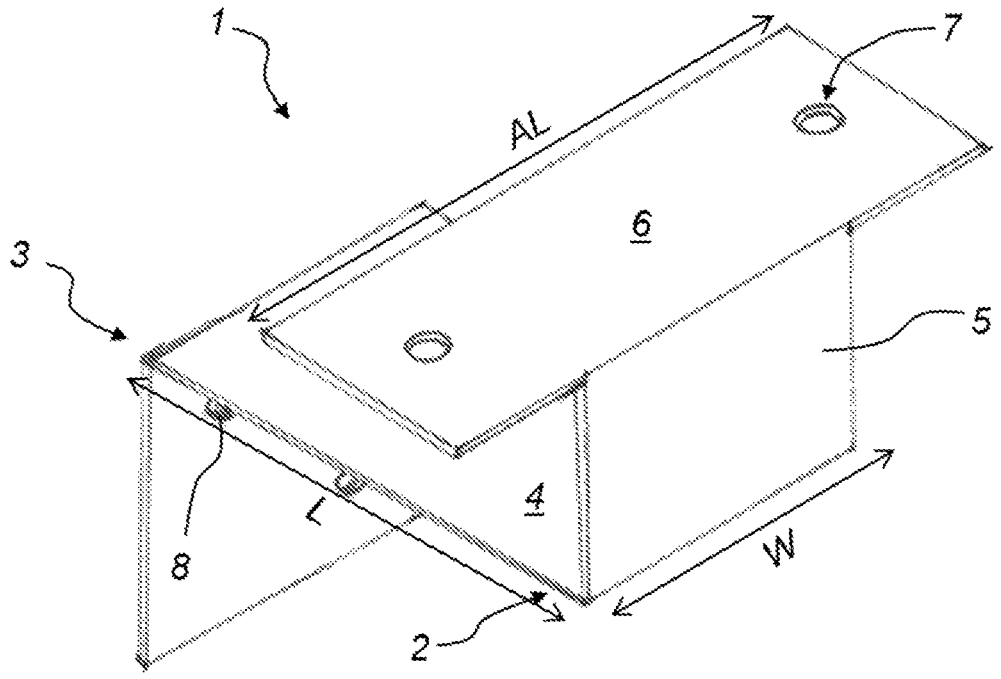

With reference to FIG. 2, a bracket 1 for holding a suspended ceiling is shown. The bracket 1 has a first end 2 for anchoring the bracket 1 to a beam or the like of a building structure and a second end 3 to which a mounting profile is attachable on which a building panel is mountable. The bracket 1 has a rectangular and flat part 4 horizontally arranged between the first and second ends 2, 3.

The length L of the flat part 4 between the first and second ends 2, 3 is in the shown embodiment 1.7 times as long as the width W of the flat part 4.

The length L of the flat part 4 is about 45 times the thickness T of the flat part 4.

As further can be seen in FIG. 2, the second end 3 of the bracket 1 has the same width W as the flat part 4 and perpendicular to the plane of the flat part 4, the second end 3 pointing downwards.

Also, the first end 2 of the bracket 1 has a connector part 5 is connected to an anchor part 6. The connector part 5 has the same width W as the flat part 4 and perpendicular to the plane of the flat part 3, the connector part 5 pointing upwards.

The anchor part 6 is a flat rectangular part and the length AL of the anchor part 6 is twice the width W of the connector part 5. The plane of the anchor part 6 is parallel with the plane of the flat part 3. The connector part 5 is arranged centrally on one of the long sides of the anchor part 6. The anchor part 6 comprises attachment means 7 in the forms of apertures/holes at the ends of the anchor part (6) and outside the connector part when seen from above, see FIG. 3. As a result, this allows for easy access when for instance screwing the bracket 1 to a building structure.

Further holes 8 are provided on the second end 3 of the bracket 1 for allowing a mounting profile to be attached on which a building panel is mountable. Looking at FIG. 2, the mounting profile could be fastened on the left side of the bracket 1 such that the screws are inserted from the right side of the second end 3. Alternatively, the mounting profile could be fastened on the right side of the bracket 1 such that the screws are inserted from the left side of the second end 3.

Also, the bracket 1 is made of a single piece of bent metal sheet. For facilitating the bending of the metal sheet, smaller apertures could be cut out on the edges of the metal sheet where the folds are to be made.

It is to be understood that the present invention is not limited to the embodiments described above and illustrated in the drawings; rather, the skilled person will recognize that many changes and modifications may be made within the scope of the appended claims. For example, the length L of the flat part 4 could be between 30 and 70 times the thickness T of the flat part 4.

The invention claimed is:

1. A floor joist system comprising:

a flat sheet metal structural web member adapted to interconnect a pair of parallel spaced apart wood chord members, said web member being V-shaped and including first and second legs integrally joined at one of their respective ends, a first plurality of teeth struck from said one end of the first and second legs and extending from an inside face of the web member, said first plurality of teeth being adapted to be driven into one of the chord members, and a second plurality of teeth struck from the other ends of the first and second legs and extending from the inside face of the web member, said second plurality of teeth being adapted to be driven into the other of said chord members; and a bracket adapted to hold a suspended ceiling, said bracket having a first end adapted to anchor the bracket to one of said wood chord members, and a second end adapted to attach to a mounting profile on which a building panel is mountable, the bracket having a rectangular and flat part that in use is horizontally arranged between the first and second ends of the bracket, a length of the flat part between the first and second ends is at least 1.5 times as long as a width of the flat part;

wherein the bracket comprises a connector part located at the first end of the bracket and extending upward from the flat part, and a mounting part located at the first end of the bracket and connected to the connector part, the mounting part extending laterally outward from the connector part and the flat part.

2. The floor joist system according to claim 1, further comprising the building panel, wherein the building panel is a gypsum board.

3. The floor joist system according to claim 1, further comprising the building panel, wherein the building panel comprises a gypsum board and a gypsum fireboard.

4. The floor joist system according to claim 1, further comprising a floor chipboard arranged on top of an upper surface of one of said wood chord members.

5. The floor joist system according to claim 4, further comprising a sound insulating mat arranged above the floor chipboard.

6. The floor joist system according to claim 4, further comprising a gypsum board arranged above the floor chipboard.

7. The floor joist system according to claim 5, further comprising a gypsum board arranged above the sound insulating mat.

8. The floor joist system according to claim 1, wherein the length of the flat part between the first and second ends is longer than 1.6 times the width of the flat part and shorter than 1.8 times the width of the flat part.

9. The floor joist system according to claim 1, wherein the bracket is made of a single piece of bent metal sheet.

10. The floor joist system according to claim 8, wherein the bracket is made of a single piece of bent metal sheet.

11. The floor joist system according to claim 1 wherein the bracket further comprises a ceiling part located at the second end of the bracket and extending downward from the flat part.

12. The floor joist system according to claim 1 wherein the flat part of the bracket has a thickness and the length of the flat part is between 30 and 70 times the thickness of the flat part.

13. A floor joist system comprising:

a pair of parallel spaced apart wood chord members; a flat sheet metal structural web member interconnecting the pair of parallel spaced apart wood chord members, said web member being V-shaped and including first and second legs integrally joined at one of their respective ends, a first plurality of teeth struck from said one end of each of the first and second legs and extending from an inside face of the web member, said first plurality of teeth being embedded in one of the chord members, and a second plurality of teeth struck from the other end of each of the first and second legs and extending from the inside face of the web member, said second plurality of teeth being embedded in the other of said chord members; and a bracket adapted to hold a suspended ceiling, said bracket having a first end attached to one of said wood chord members, and a second end adapted to attach to a mounting profile on which a building panel is mountable, the bracket having a rectangular and flat part horizontally arranged between the first and second ends of the bracket, a length of the flat part between the first and second ends is at least 1.5 times as long as a width of the flat part;

wherein the bracket comprises a connector part located at the first end of the bracket and extending upward from the flat part, and a mounting part located at the first end of the bracket and connected to the connector part, the mounting part extending laterally outward from the connector part and the flat part.

14. The floor joist system according to claim 13, further comprising the suspended ceiling, the suspended ceiling including the mounting profile attached to the second end of the bracket and the building panel mounted to the mounting profile.

15. The floor joist system according to claim 14, wherein the building panel comprises gypsum board.

16. The floor joist system according to claim 14, further comprising a floor chipboard arranged on top of an upper surface of one of said wood chord members.

17. The floor joist system according to claim 16, further comprising a sound insulating mat arranged above the floor chipboard.

18. The floor joist system according to claim 17, wherein the length of the flat part between the first and second ends is longer than 1.6 times the width of the flat part and shorter than 1.8 times the width of the flat part.

19. The floor joist system according to claim 18, wherein the bracket is made of a single piece of bent metal sheet.

20. The floor joist system according to claim 13 wherein the bracket further comprises a ceiling part located at the second end of the bracket and extending downward from the flat part.

21. The floor joist system according to claim 13 wherein the flat part of the bracket has a thickness and the length of the flat part is between 30 and 70 times the thickness of the flat part.

* * * * *